US010142725B2

(12) United States Patent
Delamour

(10) Patent No.: US 10,142,725 B2
(45) Date of Patent: Nov. 27, 2018

(54) DEVICE FOR TRANSMITTING SOUNDS FOR INTRA-AURICULAR EARPIECE AND INTRA-AURICULAR EARPIECE

(71) Applicants: Richard Chene, Neuilly (FR); Alain Miklitarian, Paris (FR); Dominique Delamour, Les Mesnuls (FR)

(72) Inventor: Dominique Delamour, Les Mesnuls (FR)

(73) Assignees: Richard Chene, Neuilly (FR); Dominique Delamour, Les Mesnuls (FR); Alain Miklitarian, Paris (FR)

( * ) Notice: Subject to any disclaimer, the term of this patent is extended or adjusted under 35 U.S.C. 154(b) by 0 days.

(21) Appl. No.: 15/330,835

(22) PCT Filed: May 4, 2015

(86) PCT No.: PCT/EP2015/059639

§ 371 (c)(1),
(2) Date: Nov. 7, 2016

(87) PCT Pub. No.: WO2015/169713

PCT Pub. Date: Nov. 12, 2015

(65) Prior Publication Data

US 2017/0180847 A1 Jun. 22, 2017

(30) Foreign Application Priority Data

May 5, 2014 (FR) ..... 14 54035

(51) Int. Cl.
*H04R 1/28* (2006.01)
*H04R 1/10* (2006.01)
(Continued)

(52) U.S. Cl.
CPC ..... *H04R 1/2849* (2013.01); *H04R 1/2857* (2013.01); *G10K 11/22* (2013.01);
(Continued)

(58) Field of Classification Search
CPC .. H04R 1/1008; H04R 1/1016; H04R 1/2849; H04R 1/2857; H04R 1/105; H04R 1/2811; H04R 25/65
See application file for complete search history.

(56) References Cited

U.S. PATENT DOCUMENTS 2,835,334 A * 5/1958 McDonald ..... H04R 1/026 181/175
4,176,730 A * 12/1979 Mushkin ..... H04R 1/2811 181/148

(Continued)

FOREIGN PATENT DOCUMENTS

| | | |
|---|---|---|
| EP | 0360517 A2 | 3/1990 |
| EP | 0421681 A2 | 4/1991 |
| FR | 2915049 A1 | 10/2008 |

OTHER PUBLICATIONS

International Search Report for PCT Serial No. PCT/EP2015/059639 dated Jul. 2, 2015.

*Primary Examiner* — Matthew Eason
*Assistant Examiner* — Taunya McCarty
(74) *Attorney, Agent, or Firm* — McCormick, Paulding & Huber LLP

(57) ABSTRACT

A device for transmitting sounds for intra-auricular earpiece, comprising an entrance opening extending along an entrance axis, said entrance opening being able to receive a sound emission source, an exit opening able to be presented in an ear and a diffusion enclosure able to conduct the sound from upstream to downstream from said entrance opening to said exit opening, said diffusion enclosure comprising, opposite said entrance opening, a first vibration wall extending orthogonally to the entrance axis able to resonate following a sound emission along said entrance axis.

13 Claims, 3 Drawing Sheets

(51) Int. Cl.
*G10K 11/22* (2006.01)
*H04R 1/34* (2006.01)

(52) U.S. Cl.
CPC ..... *H04R 1/105* (2013.01); *H04R 1/1016* (2013.01); *H04R 1/1075* (2013.01); *H04R 1/2811* (2013.01); *H04R 1/345* (2013.01)

(56) References Cited

U.S. PATENT DOCUMENTS

| | | | | |
|---|---|---|---|---|
| 6,307,943 | B1 * | 10/2001 | Yamagishi | H04R 1/1075 181/132 |
| 7,349,550 | B2 * | 3/2008 | Oliveira | H04R 1/10 381/374 |
| 7,433,483 | B2 * | 10/2008 | Fincham | H04S 1/002 381/337 |
| 8,452,039 | B2 * | 5/2013 | Wright | H04R 1/105 381/370 |
| 8,811,644 | B2 | 8/2014 | Chene et al. | |
| 2004/0037444 | A1 | 2/2004 | Redmer et al. | |
| 2008/0013771 | A1 | 1/2008 | Zhu | |
| 2009/0154755 | A1 | 6/2009 | Yamagishi et al. | |

* cited by examiner

DEVICE FOR TRANSMITTING SOUNDS FOR INTRA-AURICULAR EARPIECE AND INTRA-AURICULAR EARPIECE

CROSS-REFERENCE TO RELATED APPLICATIONS

This application is entitled to the benefit of and incorporates by reference subject matter disclosed in the International Patent Application No. PCT/EP2015/059639 filed on May 4, 2015 and French Patent Application 1454035 filed May 5, 2014.

TECHNICAL FIELD

The present invention relates to the field of devices for transmitting sound, in particular music.

BACKGROUND ART

In the prior art, an audio headset has been disclosed, which is suitable for being worn on the head, comprising two earpieces connected by an arch and used to cover the ears of the wearer of the headset. These earpieces are commonly referred to as closed earpieces. In the same way, earpieces without connecting arch are known, which are to be positioned directly in an ear. These earpieces are commonly referred to as intra-auricular earpieces. For example, an intra-auricular earpiece is known which comprises a plug for closing the entrance of the auditory meatus of an ear and an intra-auricular earpiece that is mounted freely in said auditory meatus, as taught by the patent application FR2915049.

Conventionally, an intra-auricular earpiece comprises an electronic loudspeaker on which a flexible endpiece is mounted, which is to be stuck directly in the meatus of an ear. Such an earpiece emits sounds in the immediate proximity of the tympanum of the ear, the path of circulation of the sound in the flexible endpiece being short, on the order of 2-3 cm.

The sound performances of such intra-auricular earpieces are not optimal. The sound performances can be determined as a function of several parameters, in particular, the quality of the high pitch sounds, the quality of the medium pitch sounds, the quality of the low pitch sounds, and the spatiality of the sounds emitted. As a reminder, spatiality corresponds to the potential for sounds to be interpreted by the brain of the listener as originating from various sources and different locations. For example, when an earpiece is capable of reconstituting the spatiality, the listener hears sounds originating from various sources positioned at various distances from the listener. In particular, woodwind instruments can seem closer to the listener than brass instruments, which improves the immersion of the listener.

In practice, the conventional intra-auricular earpieces do not present sufficient spatiality, given that the loudspeaker of the earpiece is very close to the ear of the listener, which presents a disadvantage.

In order to remedy this disadvantage, an earpiece is known, the loudspeaker of which comprises an electronic module capable of generating a spatiality of the sounds by offsetting certain frequencies with respect to others. Without speaking of its high cost, such an earpiece provides an artificial spatiality, which is not optimal for enabling the immersion of the listener.

Therefore, the aim of the invention is to overcome these disadvantages by proposing an earpiece of simple design, which is capable of providing a sound that has optimal spatial qualities in order to improve the listening of the listeners.

SUMMARY

To this effect, the invention relates to a device for transmitting sounds for an intra-auricular earpiece, comprising an entrance opening extending along an entrance axis, said entrance opening being able to receive a sound emission source, an exit opening able to be presented in an ear and a diffusion enclosure able to conduct the sound from upstream to downstream from said entrance opening to said exit opening.

The device is characterized in that said diffusion enclosure comprises, opposite said entrance opening, a first vibration wall extending orthogonally to the entrance axis able to resonate following a sound emission along said entrance axis.

The device for transmitting sounds according to the invention thus fulfills the function of a vibration box which makes it possible to offset the frequencies of sounds emitted by the sound emission source and thus increase the spatiality of the sounds. In contrast to a conventional earpiece, the immersion of the listener is increased. During tests, the listener does not sense any compression of the sound. On the contrary, the listening is accessible and natural.

Such an immersion is all the more pleasant since it is brought about mechanically by vibration of a wall. A wall orthogonal to the emission source enables an optimal vibration without deformation of the sounds. In addition, the distance between the entrance opening and the exit opening makes it possible to increase the spatiality in comparison to a conventional earpiece which is attached in proximity of the meatus of the ear. Preferably the entrance opening and the exit opening are offset by at least 5 cm, preferably by at least 10 cm.

Preferably, the device for transmitting sounds has a curved shape which is able to be mounted on an upper part of an ear so as to improve the ergonomics. Thus, there is synergy between the sound conduction function and the function of wearing the earpiece.

Preferably, the diffusion enclosure comprises an upstream portion having a decreasing cross section. Thus, the sounds can be compressed advantageously during their transmission, which improves the dynamics and the intensity of said sounds.

According to a preferred aspect, the diffusion enclosure comprises a second vibration wall which is substantially parallel to said first vibration wall. Thus, two vibration walls make it possible to increase the vibrations in the transmission device, thus increasing the spatiality of the sounds.

Preferably, the entrance opening is formed in the second vibration wall, which limits the space taken up by the transmission device.

Preferably, the diffusion enclosure comprises at least one upper soundpost in contact with the first vibration wall so as to stretch it. The upper soundpost makes it possible to increase the tension of the first vibration wall so that it vibrates like the skin of a drum. In addition, this makes it possible to increase the power of the sounds and thus to avoid the use of an excessively large sound emission source.

Preferably, the diffusion enclosure comprising a second vibration wall parallel to the first vibration wall, said upper soundpost is mounted between the first vibration wall and the second vibration wall, in order to mechanically transmit the vibrations between said vibration walls. Thus, the vibrations of the two vibration walls are synchronized, which increases the spatiality of the sound.

Preferably, said upper soundpost extends substantially parallel to said entrance axis. Thus, said upper soundpost has a limited space requirement in the diffusion enclosure, which limits the risk of attenuation of the power of the sounds.

According to a preferred aspect, said diffusion enclosure extending longitudinally, the diffusion enclosure comprises at least one balance piece mounted in a lateral edge of said diffusion enclosure and protruding into the cavity of said diffusion enclosure. The balance piece, like the bass bar of a violin, enables the synthesizing of the sounds in order to balance the different sounds originating from the vibrations so as to form a coherent whole.

Preferably, said diffusion enclosure comprising an upper soundpost, said balance piece is mounted downstream of said upper soundpost. Thus, said balance piece can filter all the sounds originating from vibrations. Advantageously, the balance piece and the upper soundpost do not come in contact.

Preferably, the device for transmitting sounds comprises a blind lower chamber. Such a blind chamber makes it possible to lengthen the path of circulation of the sounds between the entrance opening and the exit opening, which improves the spatiality as well as the dynamics.

Preferably, said blind lower chamber extends in the extension of the diffusion enclosure. Thus, the communication between the lower chamber and the diffusion enclosure is direct. Also preferably, the first vibration wall forms a portion of the diffusion enclosure and of the lower chamber. Still preferably, the second vibration walls forms a portion of the diffusion enclosure and of the lower chamber.

Also preferably, said blind lower chamber comprises a lower soundpost so as to increase the vibrations in the lower chamber in order to reinforce the spatiality effect. In addition, this makes it possible to increase the power of the sounds and thus it makes it possible to avoid using an excessively large sound emission source.

Preferably, said blind lower chamber comprises a movable wall suitable for modifying the depth of said blind lower chamber. Advantageously, such a mobile wall allows the listener to adjust the length of the path of circulation of the sounds, which makes it possible to adjust the high pitch, medium pitch and low pitch components of the sounds. In other words, the listener can adjust each earpiece to his/her preference, so as to enjoy optimal listening with a spatiality adapted to his/her tastes.

The invention also relates to an earpiece comprising a device for transmitting sounds as presented above, and a sound emission source mounted in the entrance opening of said device for transmitting sounds.

BRIEF DESCRIPTION OF THE DRAWINGS

The invention will be better understood upon reading the following description given only as an example and referring to the appended drawings in which.

It should be noted that the figures describe the invention in a detailed manner in order to enable the implementation of the invention; said figures naturally can also be used to better define the invention if applicable.

DETAILED DESCRIPTION

Figure 1:
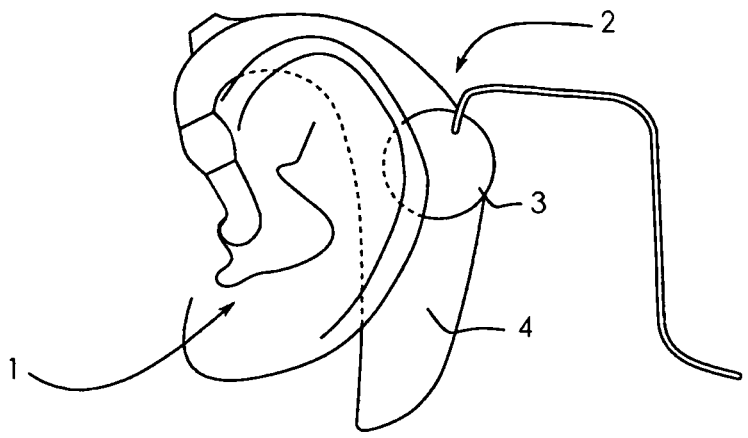
FIG. 1 is a diagrammatic representation of an earpiece according to the invention in the position of use.

In reference to FIG. 1, a diagrammatic representation is shown of an intra-auricular earpiece 2 according to the invention, mounted on a human ear 1 in position of use.

The intra-auricular earpiece 2 comprises a device for transmitting sounds 4 in which a sound emission source 3 is mounted. In this embodiment example, the sound emission source 3 is in the form of a loudspeaker having a diameter between 12 and 15 mm, connected to a portable audio player by wire. However, naturally, a wireless connection, in particular, Bluetooth, could also be appropriate.

Figure 2:
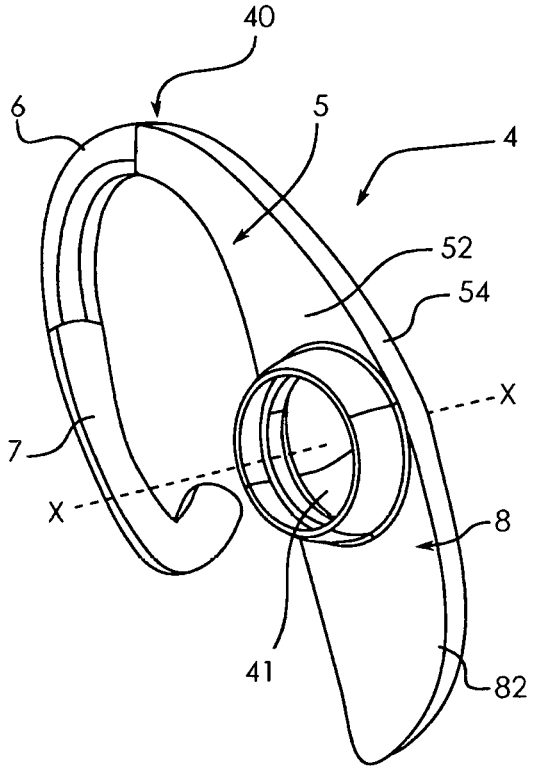
FIG. 2 is a diagrammatic representation from the front of a first embodiment of a device for transmitting sounds.
Figure 3:
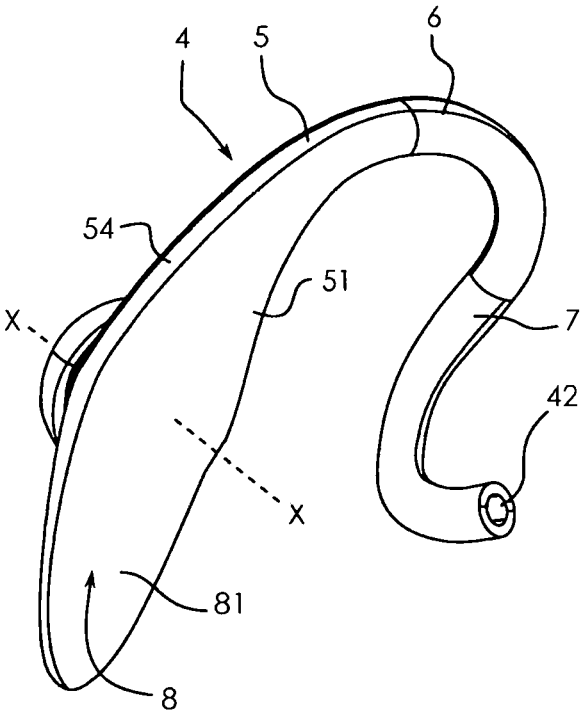
FIG. 3 is a diagrammatic representation from the rear of the device for transmitting sounds of FIG. 2.

As illustrated in FIGS. 2 and 3, the device for transmitting sounds 4 comprises an entrance opening 41 extending along an entrance axis X, which is able to receive the sound emission source 3, in particular, a loudspeaker. Also, preferably, the entrance opening 41 has an annular shape so as to cooperate by complementarity of shapes with a loudspeaker having an annular shape. The device for transmitting sounds 4 moreover comprises an exit opening 42 which is able to be inserted in the meatus of the ear. To this effect, the exit opening 42 has a diameter on the order of 3 to 5 mm so as to create a high final compression, in order to obtain a high decompression in the ear of the listener so as to increase the dynamic behavior of the sounds received. Preferably, the diameter of the exit opening 42 is on the order of 3 to 4 mm.

According to the invention, the device for transmitting sounds 4 includes a diffusion enclosure 40 which is able to conduct the sound from upstream to downstream from said entrance opening 41 to said exit opening 42. In this embodiment, the device for transmitting sounds 4 comprises a blind lower chamber 8 which extends from the entrance opening 41. Blind chamber 8 is understood to mean a chamber that has no opening except for the entrance opening 41. As will be presented below, the blind lower chamber 8 makes it possible to reflect the sounds originating from the entrance opening 41 before returning them to the outlet opening 42.

Preferably, the device for transmitting sounds comprises only a single entrance opening 41 and only a single exit opening 42, in order to avoid any decrease in the power of the sounds between the entrance opening 41 and the exit opening 42. Preferably, the entrance opening 41 comprises a damper (glue, elastomer gasket, etc.) for damping the vibrations generated by the sound emission source 3.

As illustrated in FIGS. 1 to 3, the device for transmitting sounds 4 is curved so as to enable the ergonomic suspension thereof on an ear 1.

Diffusion Enclosure 40

As will be shown below, the diffusion enclosure 40 enables a direct transmission of the sounds from the entrance opening 41 to the exit opening 42, and a mechanical processing of the sounds by vibrations.

In this embodiment, the diffusion enclosure 40 comprises, successively, an upstream portion 5, an intermediate portion 6, and a downstream portion 7, for conducting the sound between the entrance opening 41 and the exit opening 42. In this example, the portions 5, 6, 7 are connected to one another by interlocking; however, naturally, certain portions could form a monoblock assembly, in particular, the upstream portion 5 and intermediate portion 6, so that the downstream portion 7 remains orientable by the listener in order to facilitate the placement of the earpiece 2 on his/her ear.

Below, the portions 5, 6, 7 of the diffusion enclosure 40 will be presented independently.

The Upstream Portion 5

The upstream portion 5 makes it possible advantageously to generate resonance in the diffusion enclosure 40, in order to mechanically offset the sound frequencies so as to generate a spatiality of the sounds. Subsequently, the upstream portion 5 will also be referred to as resonance chamber 5.

Preferably, the upstream portion 5 extends in a plane orthogonal to the entrance axis X at the level of the entrance opening 41. To this effect, in reference to FIGS. 2 and 3, the upstream portion 5 includes a first vibration wall 51 opposite the entrance opening 41 and which extends orthogonally to the entrance axis X. In the same way, the upstream portion 5 includes a second vibration wall 52 which is substantially parallel to the first vibration wall 51. As illustrated in FIG. 2, the entrance opening 41 is formed in the second vibration wall 52 so that the sound waves originating from the sound emission source come in contact with the first vibration wall 51, in in order then to be guided from upstream to downstream between the vibration walls 51, 52. Still in reference to FIGS. 2 and 3, the vibration walls 51, 52 are laterally connected by an internal lateral wall 53 and an external lateral wall 54. The vibration walls 51, 52 can be curved while remaining parallel to one another in order to match the shape of the listener's skull while at the same time ensuring an optimal vibration.

In reference to FIGS. 2 and 3, the upstream portion 5 of the diffusion enclosure 40 has a cross section which decreases from upstream to downstream so as to enable a compression of the sounds. Preferably, the upstream portion 5 is curved at its downstream end so as to enable the mounting thereof on an ear 1 as presented above.

Preferably, the upstream portion 5 is formed from a rigid material of the PVC type in order to enable an optimal vibration of the vibration walls 51, 52, but naturally other materials could also be suitable.

Preferably, the upstream portion 5 has a length between 3 and 5 cm, and an upstream width between 10 and 15 mm and a downstream width between 3 and 5 mm. Advantageously, the upstream width is adapted to the width of the sound emission source, that is to say, of the loudspeaker. Naturally, other dimensions could also be suitable.

Also preferably, the thickness of the upstream portion 5 is on the order of 1-3 mm so that a sound emission source can cause the first vibration wall to vibrate optimally.

The Intermediate Portion 6

The intermediate portion 6 advantageously makes it possible to guide the compressed sound between the upstream portion 5 and the downstream portion 7. In reference to FIGS. 2 and 3, the intermediate portion 6 of the diffusion enclosure 40 has a cross section that is substantially constant from upstream to downstream and curved.

The Downstream Portion 7

The downstream portion 7 advantageously makes it possible to guide the compressed sound from the intermediate portion 6 to the meatus of the ear 7. For this purpose, the downstream portion 7 is bent so as to facilitate the insertion thereof in the meatus of the ear 1 after its passage around the auricle of the ear 1. In reference to FIGS. 2 and 3, the intermediate portion 6 of the diffusion enclosure 40 has cross section that is substantially constant from upstream to downstream.

Optionally, the downstream end of the downstream portion 7 can be provided with an endpiece 9 (FIG. 4) in order to improve the interaction between the device for transmitting sounds 4 and the ear 1 of the listener. Preferably, said endpiece 9 is made of an elastomer material.

According to another aspect, the diffusion enclosure 40 is configured to maintain the exit opening of the transmission device in the entrance of the concha so as to enable the listener to listen to the outside sounds as taught by the patent application FR2915049.

Blind Lower Chamber 8

In addition to the diffusion enclosure 40, the device for transmitting sounds 4 comprises a blind lower chamber 8 which extends in the extension of the upstream portion 5 of the diffusion enclosure 40. In other words, the blind lower chamber 8 is diametrically opposite the diffusion enclosure 40 with respect to the entrance opening axis 41 as illustrated in FIG. 2. Preferably, the diffusion enclosure 40 and the blind lower chamber 8 are made of the same material, in particular, PVC.

The blind lower chamber 8 is preferably hollow, that is to say it is provided with a cavity. Moreover, the blind lower chamber 8 enables the guiding of the sounds in its cavity before guiding them in the diffusion chamber 40 prior to their escape at the level of the exit opening 42. The guiding of the sound in the blind lower chamber 8 makes it possible to increase the separation between the frequencies of the sound (high pitch, medium pitch and low pitch) and thus to reinforce the spatiality of the sounds perceived by the user. Such a lower chamber 8 is thus particularly advantageous.

In a manner similar to the resonance chamber 5, the lower chamber 8 comprises a first vibration wall 81 extending in the extension of the first vibration wall 51 of the resonance chamber 5 and a second vibration wall 82 extending in the extension of the second vibration wall 52 of the resonance chamber 5.

The length of the lower chamber 8 is parametrized so that the superposition of the sound circulating directly in the diffusion enclosure 40 (direct sounds) and those circulating indirectly after reflection in the bottom of the lower chamber 8 (indirect sounds) is not directly perceptible by the human ear. Preferably, the length of the lower chamber 8 is less than 30 mm, in order to avoid an unpleasant superposition of the direct and indirect sounds, and is greater than 10 mm so as to generate a spatiality perceptible by the human ear. In practice, the length of the lower chamber 8 is equal to approximately 20% of the length of the resonance chamber, that is to say the length of the upstream portion 5 of the diffusion enclosure 40.

Preferably, the walls of the lower chamber 8, and in particular the lateral walls thereof, are thickened in comparison to the walls of the diffusion enclosure 40 so as to favor the medium pitch and low pitch components of the sounds circulating in the lower chamber 8. For example, the thickness of the lateral walls of the lower chamber 8 is on the order of 2-4 mm.

The blind lower chamber 8 is optional, and, naturally, it would be possible for the device for transmitting sounds 4 not to include such a blind lower chamber 8.

Advantageously, when the device for transmitting sounds 4 does not comprise a lower chamber 8, it can be provided with a wedging device suitable for being placed in proximity of the lobe of the ear 1 in order to stabilize the earpiece 2 on the ear 1.

By means of the device for transmitting sounds 4 according to the invention, the sound emissions result in a vibration of the first vibration wall 51 of the resonance chamber 5, which causes an offset of the "ordered" sounds originating from the entrance opening 41. For the listener this results in a sensation of auditory openness, that is to say an increase in the separation between the "right" and "left" parts of stereo music during listening. Moreover, the sensory perceptions are increased. The listener advantageously does not need to increase the volume to enjoy better immersion.

Figure 4:
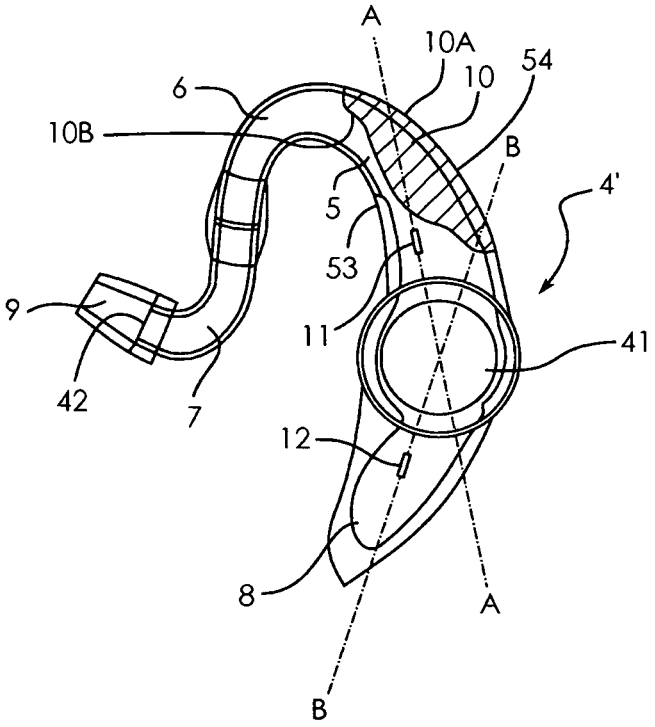
FIG. 4 is a diagrammatic representation in cross section of a second embodiment of a device for transmitting sounds.
Figure 5:
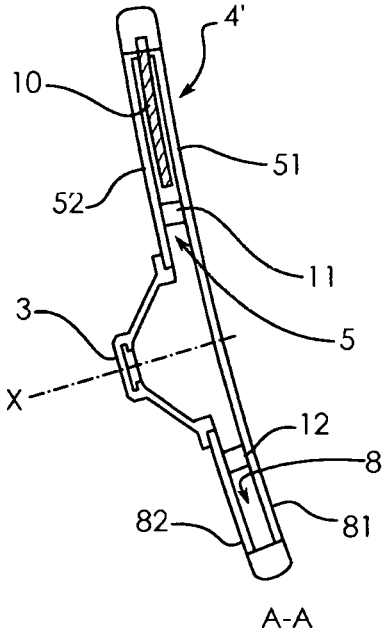
FIG. 5 is a cross-sectional view according to A-A of the device for transmitting sounds of FIG. 4.
Figure 6:
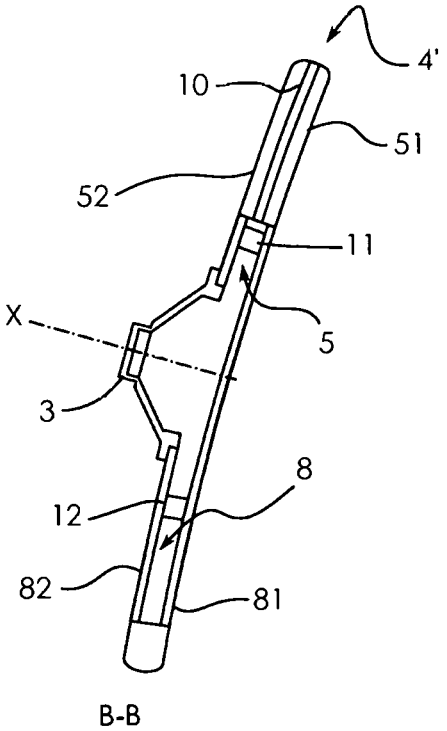
FIG. 6 is a cross-sectional view according to B-B of the device for transmitting sounds of FIG. 4.

A second embodiment of the invention is described in reference to FIGS. 4 to 6. In order to simplify the description, the same references are used to describe the elements having identical, equivalent or similar structure or function compared to those of the elements of FIGS. 2 and 3. Moreover, the entire description of the embodiment of FIGS. 2 and 3 is not repeated, since this description applies to the elements of FIGS. 4 to 6 unless there are incompatibilities. Only the notable structural and functional differences are described.

According to a second embodiment of the device for transmitting sounds 4' according to the invention, in reference to FIGS. 4 to 6, the device for transmitting sounds 4' comprises a balance piece 10 mounted in the external lateral edge 54 of the upstream portion 5 of the diffusion enclosure 40 and extending in the cavity of the diffusion enclosure 40. In other words, the balance piece 10 comprises an attachment edge 10A and a free edge 10B as illustrated in FIG. 4.

In this example, the balance piece 10 extends from the external lateral edge 54 to the lower lateral edge 53 of the upstream portion 5 as illustrated in FIG. 4. The attachment edge 10A of the balance piece 10 is fastened sealingly in the external lateral edge 54 in order to prevent any loss of power of the transmitted sounds.

Preferably, the free end of the balance piece 10 extends at a distance from the lower lateral edge forming a constriction for the sounds in order to adapt the medium pitch component of the sounds. The sounds thus circulate above, below and at the free end of the balance piece 10 in order to be modified by said balance piece 10.

In reference to FIG. 5, the balance piece 10 is in the form of a flat piece, which extends between the first vibration wall 51 and the second vibration wall 52 so as to influence the sounds originating from the entrance opening 41. The balance piece 10 extends preferably parallel to the vibration walls 51, 52.

The balance piece 10 makes it possible, like a bass bar of a violin, to equalize the components of the sounds of the diffusion enclosure 40. Thus, the vibrations originating from the vibration walls 51, 52 of the upstream portion 5 are smoothened by the balance piece 10. In other words, the balance piece 10 fulfills an equalizer function for the sounds of the upstream portion 5.

The balance piece 10 is preferably made of wood, plastic or a composite material. The nature of the material forming the balance piece 10 results from a compromise between its resonance properties and its absorption properties. Alternatively, the balance piece 10 can be made of the same material as the upstream portion of the diffusion enclosure 40. Such an alternative makes it possible to reduce the cost of the device for transmitting sounds 4', no step of assembling the balance piece 10 being required anymore.

Preferably, still in reference to FIGS. 4 to 6, the device for transmitting sounds 4' comprises an upper soundpost 11 and a lower soundpost 12, which are accommodated in the resonance chamber 5 and in the blind lower chamber 8, respectively.

The upper soundpost 11 is arranged so as to exert a mechanical tension between the vibration walls 51, 52 in order to improve their vibratory characteristics like a soundpost of a violin. In other words, the upper soundpost 11 makes it possible to mechanically connect the first vibration wall 51 to the second vibration wall 52, so that the entire vibration of the first vibration wall 51 is communicated to the second vibration wall 52. The lower soundpost 12 makes it possible to fulfill the same function for the vibration walls 81, 82 of the lower chamber 8.

As illustrated in FIG. 4, the upper soundpost 11 is mounted in the diffusion enclosure 40 in proximity of the center of the upstream portion 5. In a similar manner, the lower soundpost 12 is mounted in the blind lower chamber 8 in proximity of its center.

Preferably, when an upper soundpost 11 is used with a balance piece 10 in a resonance chamber 5, the balance piece 10 comprises an upstream portion having a smaller cross section so as to enable the placement of the upper soundpost 11 in the diffusion enclosure 40 in proximity of the balance piece 10 as illustrated in FIG. 4, the upper soundpost 11 and the balance piece 10 being not in contact.

In this implementation example, each soundpost 11, 12 is in the form of an element extending orthogonally to the vibration walls 51, 52, 81, 82, that is to say substantially parallel to the entrance axis X. Each soundpost 11, 12 has, in addition, a length that is slightly greater than the thickness of the chambers 5, 8 in which they are accommodated, preferably, on the order of 10%. In other words, each soundpost 11, 12 is mounted prestressed in the chambers 5, 8 in order to stretch the vibration walls 51, 52, 81, 82 like a drum.

Naturally, the device for transmitting sounds 4' could include only a single soundpost 11, 12. In the same way, the device for transmitting sounds 4' could include one or more soundposts 11, 12 without balance piece 10.

The soundposts 11, 12 make it possible to transmit the vibrations of the first vibration walls 51, 81 to the second vibration walls 52, 82 mechanically. The setting in vibration of several vibration walls 51, 52, 81, 82 of a chamber 5, 8 makes it possible to reinforce the offset of the frequencies of the sounds and thus to increase the spatiality.

The soundposts 11, 12 make it possible to act on the dynamics of the sounds by increasing the separation between the soft sounds and the loud sounds so as to provide a striking proximity effect. For example, for some acoustic music, the listener has the sensation that the sounds are being played in front of him/her, which reinforces the impression of immersion.

Figure 7:
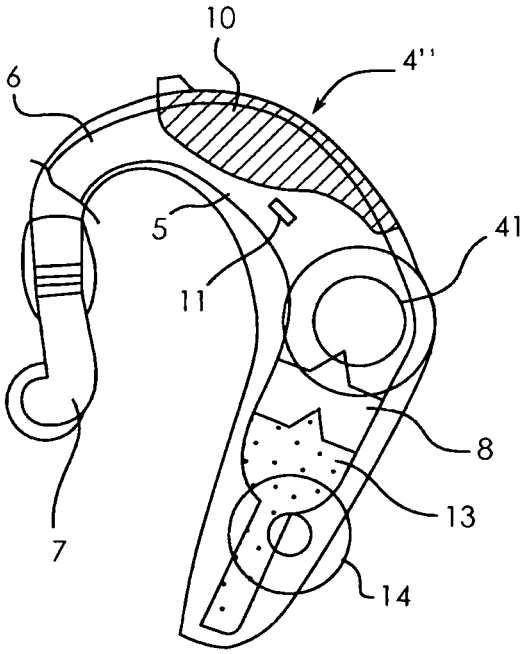
FIG. 7 is a diagrammatic representation in cross section of a third embodiment of a device for transmitting sounds.
Figure 8:
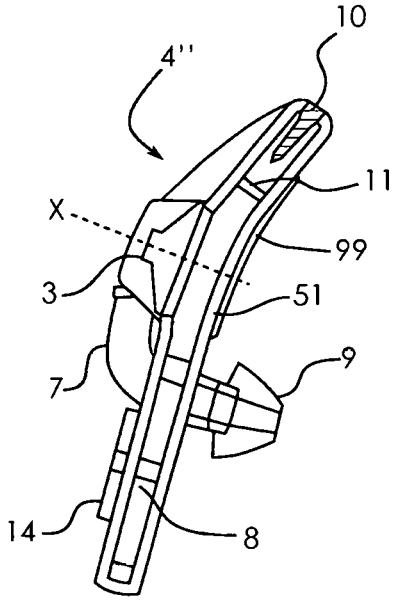
FIG. 8 is a diagrammatic representation in lateral cross section of the device for transmitting sounds of FIG. 7.
Figure 9:
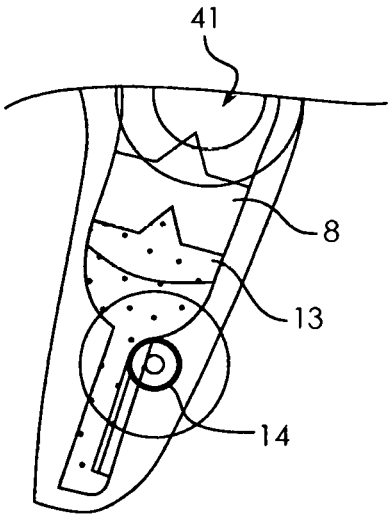
FIG. 9 is a diagrammatic representation of a step of adjustment of the device for transmitting sounds of FIGS. 7 and 8.

According to a third embodiment of a device for transmitting sounds 4" according to the invention, in reference to FIGS. 7 to 9, the blind lower chamber 8 comprises an adjustable movable wall 13 suitable for modifying the volume of the blind lower chamber 8. To this effect, the device for transmitting sounds 4" includes a control device 14 suitable for moving in translation said movable wall 13 in the blind lower chamber 8.

In this implementation example, the control device 14 is in the form of a rotating wheel which is connected by a rack connection to the adjustable movable wall 13, but naturally, the connection could be different. In particular, the control device could be in the form of a button firmly connected to the movable wall 13 and able to undergo a translational movement in a groove of the lower chamber 8. The stroke of movement of the movable wall 13 is on the order of 10-15 mm in this implementation example.

In this embodiment, the listener can adjust, for each earpiece, the spatiality of the sound that he/she wishes to have by acting on the control device 14 and thus move the movable wall 13.

In the present case, a manipulation of the control device 14 and of the movable wall 13 makes it possible to act on the frequency components of the sounds in order to reach the "auditory satisfaction point" known to the person skilled in the art by the English term "sweet spot," such an auditory satisfaction point being specific to each listener.

With an adjustment adapted to each ear of the listener, the listening is more comfortable and natural. In particular, one notes an enrichment of the low pitch sounds giving the sounds more depth and an increased presence of medium pitch sounds offering a better intelligibility of the entire sound rendition.

Preferably, in reference to FIG. 8, the device for transmitting sounds 4" comprises a damping layer 99, preferably made of elastomer, attached to the external surface of the first vibration wall 51 so as to attenuate the vibrations of the low pitch components of the sounds. Naturally, such a damping layer 99 can be applied to any embodiment of the device for transmitting sounds according to the invention.

IMPLEMENTATION EXAMPLE

As an example, a user provides each one of his ears with an earpiece 2 according to the invention by hanging it from its device for transmitting sounds 4 the shape of which is curved as illustrated in FIG. 2.

The user activates his/her music reader, which emits sounds via its loudspeaker 3 in the entrance opening 41 in order to cause the vibration of the first vibration walls 51, 81 which extend orthogonally to the entrance axis X opposite the entrance opening 41. By means of the soundposts 11, 12, the second vibration walls 52, 82 also are set in vibration in a synchronized manner, which increases the offset between the frequencies of the sounds originating from the loudspeaker 3 and thus the spatiality.

Some vibrated sounds are led directly to the exit opening 42, while others are led indirectly to said exit opening after having circulated in the blind lower chamber 8. Advantageously, the user adjusts the depth of the blind chamber 8 in order to adjust the spatiality and the dynamics of the sounds.

The direct or indirect vibrated sounds are then synthesized together by the balance piece 10 which makes it possible to smoothen the sounds and improve the auditory perception. The synthesized sounds are then led through the intermediary portion 6 and the downstream portion 7 in order to increase their spatiality before being sent into the ear of the user through the outlet opening 42. In contrast to the prior art, in which the sounds are emitted very close to the ear, the sounds are emitted at a distance from the ear in order to undergo a mechanical processing which increases the spatiality of the sounds and the immersion of the listener.

By means of the invention, as a result of the synergy of its different components, improved dynamics, balancing and spatiality of the sounds are achieved.

The earpieces according to the invention enable optimal and natural listening.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A device for transmitting sounds for an intra-auricular earpiece, comprising an entrance opening extending along an entrance axis, said entrance opening being able to receive a sound emission source, an exit opening able to be presented in an ear and a diffusion enclosure able to conduct the sound from upstream to downstream from said entrance opening to said exit opening, wherein said diffusion enclosure comprises, opposite said entrance opening, a first vibration wall extending orthogonally to the entrance axis able to resonate following a sound emission along said entrance axis, and wherein the diffusion enclosure further comprises a second vibration wall substantially parallel to said first vibration wall and an upper soundpost mounted between the first vibration wall and the second vibration wall in order to mechanically transmit the vibrations between said vibration walls.

2. The device according to claim 1, in which the device for transmitting sounds has a curved shape which is able to be mounted on an upper part of an ear.

3. The device according claim 1, in which the diffusion enclosure comprises an upstream portion having a decreasing cross section.

4. The device according to claim 1, in which the entrance opening is closed in the second vibration wall.

5. The device according to claim 1, in which said upper soundpost extends substantially parallel to said entrance axis.

6. The device according to claim 1, in which, said diffusion enclosure extending longitudinally, the diffusion enclosure comprises at least one balance piece mounted in a lateral edge of said diffusion enclosure and protruding into the cavity of said diffusion enclosure.

7. The device according to claim 6, in which, said diffusion enclosure comprising an upper soundpost, said balance piece is mounted downstream of said upper soundpost.

8. The device according to claim 1, comprising a blind lower chamber.

9. The device according to claim 8, in which said blind lower chamber extends in the extension of the diffusion enclosure.

10. The device according to claim 7, in which said blind lower chamber comprises a lower soundpost.

11. The device according to claim 7, in which said blind lower chamber comprises a movable wall suitable for modifying the depth of said blind lower chamber.

12. An earpiece comprising a device for transmitting sounds according to claim 1, and a sound emission source mounted in the entrance opening of said device for transmitting sounds.

13. The device according to claim 2, in which the diffusion enclosure comprises an upstream portion having a decreasing cross section.

* * * * *